US009526969B1

(12) United States Patent
Raber

(10) Patent No.: US 9,526,969 B1
(45) Date of Patent: Dec. 27, 2016

(54) COMPOSITE ATHLETIC CUP

(71) Applicant: Jeremiah A. Raber, High Ridge, MO (US)

(72) Inventor: Jeremiah A. Raber, High Ridge, MO (US)

( * ) Notice: Subject to any disclaimer, the term of this patent is extended or adjusted under 35 U.S.C. 154(b) by 43 days.

(21) Appl. No.: 14/721,897

(22) Filed: May 26, 2015

(51) Int. Cl.
*A63B 71/12* (2006.01)
*A41D 13/05* (2006.01)

(52) U.S. Cl.
CPC ..... *A63B 71/1216* (2013.01); *A41D 13/05* (2013.01)

(58) Field of Classification Search
CPC . A63B 71/1216; A63B 71/1225; A63B 71/12; A63B 2071/1208; A41D 13/05
USPC ..... 2/2.5, 466
See application file for complete search history.

(56) References Cited

U.S. PATENT DOCUMENTS 849,471 A 4/1907 Gamble
4,257,414 A * 3/1981 Gamm ..... A63B 71/1216 602/67
5,075,904 A * 12/1991 Shirasaki ..... A42B 3/063 2/412
5,479,942 A 1/1996 DiMatteo
6,319,219 B1 * 11/2001 Landi ..... A63B 71/12 128/846
7,178,176 B1 * 2/2007 S-Cronenbold ..... A41D 13/05 2/403
7,296,307 B2 * 11/2007 Atwater ..... A63B 71/12 128/846
7,704,120 B2 * 4/2010 Chen ..... A41B 9/001 2/466
7,712,156 B2 * 5/2010 Raber ..... A41D 1/088 2/403
7,757,310 B2 * 7/2010 Wong ..... A41B 9/02 2/466
7,877,820 B2 * 2/2011 Landi ..... A41D 13/0518 2/463
7,900,285 B2 * 3/2011 Steszyn ..... A63B 71/1216 2/466
RE43,525 E * 7/2012 Landi ..... A63B 71/1216 128/846
8,500,669 B2 * 8/2013 Sheu ..... A63B 71/1216 2/466
8,567,450 B2 * 10/2013 Sringfellow ..... B29C 63/343 138/104
8,752,217 B1 * 6/2014 Cheney ..... A41D 13/0525 128/846
9,301,560 B2 * 4/2016 Wong ..... A41B 9/02
9,321,539 B2 * 4/2016 Briand ..... B32B 27/12
2003/0163076 A1 * 8/2003 Lukens ..... A63B 71/1216 602/67
2004/0024341 A1 * 2/2004 Jacobs ..... A63B 71/1216 602/72
2005/0268387 A1 * 12/2005 Wong ..... A41B 9/02 2/455

(Continued)

*Primary Examiner* — Shaun R Hurley
*Assistant Examiner* — Bao-Thieu L Nguyen
(74) *Attorney, Agent, or Firm* — Kevin L. Klug

(57) ABSTRACT

An improved composite athletic cup having a comfort surround of a flexible material and a front primary shell of a hardened and layered composite material. The comfort surround has a recess into which the primary shell fits and is bonded. The primary shell has a layered structure of carbon fiber, KEVLAR®, fiberglass, and/or DYNEEMA® in an order which provides exterior hardness and structural integrity while protecting a user from blunt impacts and projectiles.

20 Claims, 8 Drawing Sheets

(56) References Cited

U.S. PATENT DOCUMENTS

| | | | | |
|---|---|---|---|---|
| 2008/0201829 | A1* | 8/2008 | Wang | A63B 71/1216 2/466 |
| 2009/0077726 | A1* | 3/2009 | Raber | A41D 1/088 2/466 |
| 2010/0275351 | A1* | 11/2010 | Wong | A41B 9/02 2/466 |
| 2012/0090068 | A1* | 4/2012 | Glass | A41D 13/0543 2/22 |
| 2012/0156465 | A1* | 6/2012 | Micarelli | B32B 3/266 428/221 |
| 2013/0178780 | A1* | 7/2013 | Sheu | A63B 71/1216 602/72 |
| 2013/0312152 | A1* | 11/2013 | Paul | A41D 13/015 2/16 |
| 2014/0053325 | A1* | 2/2014 | Murphy | A63B 71/1216 2/466 |
| 2015/0018744 | A1* | 1/2015 | Reed | A41B 9/12 602/72 |
| 2015/0260483 | A1* | 9/2015 | Wibby | F41H 5/0478 89/36.08 |
| 2015/0268010 | A1* | 9/2015 | Strauss | F41H 7/044 89/36.02 |
| 2015/0323292 | A1* | 11/2015 | Strauss | F41H 5/0485 89/36.02 |
| 2015/0343738 | A1* | 12/2015 | Strauss | B30B 5/02 428/69 |
| 2016/0010333 | A1* | 1/2016 | Freebury | E04C 3/005 52/646 |
| 2016/0178326 | A1* | 6/2016 | Strauss | F41H 5/04 89/36.02 |

* cited by examiner

COMPOSITE ATHLETIC CUP

This application claims priority of U.S. Provisional Patent Application No. 62/029,311, filed Jul. 25, 2014, entitled Improved Composite Athletic Cup.

BACKGROUND OF THE INVENTION

The art of the present invention relates to athletic cups utilized by male and other persons during the participation in sports, martial arts, law enforcement, and military operations in general and more particularly to a uniquely formed and composite structured form of an athletic cup which is capable of protecting the person from severe groin impacts, including but not limited to an impact from a projectile such as a bullet.

When male persons are involved in sports or activities that include heavy body contact or are subjected to situations of expected attack, such as during law enforcement or military operations, it is expected that the groin area will be subjected to heavy physical blows or impacts from projectiles such as bullets. It is well understood that the male groin area is susceptible to damage or injury from heavy blows and/or fast-traveling projectiles. The most common form of protection for the aforesaid is a concave device which is known in the arts as an athletic cup which generally covers the male genital area below the abdomen and between the legs. In many instances the athletic cup is supported and held in place by an undergarment called an athletic supporter. The aforesaid are extremely common in such sports as football, baseball, basketball, soccer, hockey, and any other sport that might cause a male person's groin area to receive heavy contact.

The majority of prior art athletic cups are manufactured from injection molded polymer materials such as polypropylene or polyethylene. That is, they are often injection molded from a single polymer material. Often the edges or rims of the athletic cup are covered with a soft yet resilient material such as foam rubber without any additional cushioning or protection on the inside. An inherent requirement for an athletic cup is that it is strong and protective yet also is light in weight or mass as the user desires to limit any excess weight during some of the aforesaid activities. Prior art athletic cups are sufficient for routine sports activities but are seriously deficient for martial arts, police, and military operations. Applicant has advanced the prior art as described in his U.S. Pat. No. 7,712,156 with the present art representing an improvement to the protective cup art beyond Applicant's disclosure as claimed in U.S. Pat. No. 7,712,156.

The present art provides a unique composite structure and athletic cup form which protects against impacts and blows and further protects against small arms fire and shrapnel as found in some military and law enforcement situations.

For a preferred embodiment, the present art apparatus comprises a comfort surround of a lower durometer material with a front primary shell of a uniquely layered composite structure. The comfort surround and front primary shell are mated and bonded whereby the front primary shell substantially protects the groin area from impacts and projectiles. Unique to the form of the comfort surround is a unique taper structure on the outer walls which forces the outer shell to elongate during severe impacts rather than collapse as in many prior art athletic cups. The present art primary shell layered composite structure provides a very light weight or mass while having the strength to survive impacts from severe blows and projectiles.

Accordingly, it is an object of the present invention to provide an improved composite athletic cup which provides groin protection from severe blows and projectiles while further limiting the additional weight or mass which the user must carry.

Another object of the present invention is to provide an improved composite athletic cup having a comfort surround which is forced to extend or elongate upon impact instead of the walls collapsing and potentially causing harm.

A further object of the present invention is to provide an improved composite athletic cup having a primary shell formed from a layered structure of carbon fiber, ultra high molecular weight polyethylene, fiberglass including E-glass (alumino-borosilicate glass), or DYNEEMA® (ultra high molecular weight polyethylene fiber), and an aramid fiber such as KEVLAR® (poly-paraphenylene terephthalamide fiber) without the weight and mass disadvantage of metallic athletic cups.

A yet further object of the present invention is to provide an improved composite athletic cup having a comfort surround mated and bonded with a primary shell which absorbs and deflects impact energies without harm to the user and without destruction of the athletic cup itself.

SUMMARY OF THE INVENTION

In accordance with the present invention, the first or preferred embodiment of an improved composite athletic cup comprises a comfort surround having a substantially concave form interior and a partially recessed exterior into which fits, mates, and is bonded a front primary shell of layered composites. The comfort surround has a general form of a banana style athletic cup in a preferred embodiment yet may take a plurality of athletic cup forms in alternative embodiments including but not limited to the traditional form.

The comfort surround has a generally inverted teardrop shape as viewed from a front plan view and has a concave interior which fits over the groin area of the user. The comfort surround front has a slight recess also having an inverted teardrop shape into which the front primary shell is placed and bonded, preferably with an epoxy type material. For the preferred embodiment, the front recess has a surrounding channel or groove into which the front primary shell edges fit. The preferred embodiment surrounding channel has an inverted taper within and into which said epoxy or bonding material may form a mechanical bond with the comfort surround and mechanically hold the front primary shell.

Unique to the present art comfort surround is the slight taper of the outer walls which transition from the rear toward the front of the comfort surround. The outer walls taper in nearest the rear, i.e. toward the interior or center, and taper out nearest the front, i.e. away from the interior or center. Traditional banana style and other athletic cups have substantially straight walls from rear to front. When impacted, the traditional designs tend to collapse on one or both wall sides and allow for injury to the person. The present art tapered walls force the comfort surround athletic cup to elongate from top to bottom, thereby spreading the impact energy onto a greater area and maintaining protection for the user. For the preferred embodiment, the comfort surround is manufactured from a lightweight thermoplastic elastomer which preferably has an added foaming agent for reduced weight.

The front primary shell of layered composites also has an inverted teardrop shape which closely matches, mates with, and fits into the front recess with the outer edges of the front primary shell fitting within the surrounding channel or groove. The front primary shell is preferably compression formed, trimmed, and inserted with an adhesive or bonding agent, preferably an epoxy, into the front recess and channel or groove.

Unique to a preferred embodiment of the present art, the front primary shell has the layer structure of an outer or frontmost carbon fiber layer, a middle layer of two layers of KEVLAR® 29, followed by three layers of E-glass fiberglass (alumino-borosilicate glass), and an innermost three layers of KEVLAR® 29 which forms the inner or rearmost layer. A first alternative embodiment utilizes a front primary shell with a layer structure of an outer or frontmost carbon fiber, a middle layer of ultra high molecular weight poyethylene often described with the trade name DYNEEMA®, and a inner or rearmost layer of KEVLAR® (poly-paraphenylene terephthalamide). The aforesaid layering structure provides the stiffness due to the outer carbon fiber and inner KEVLAR® layers, the outer hardness for impact blows due to the outer carbon fiber layer, and superior projectile protection due to the sandwiched DYNEEMA® or E-glass layer. Further alternative embodiments of the present art substitute a fiberglass or KEVLAR® layer for the outermost carbon fiber layer.

The present art apparatus may be manufactured from a plurality of materials, as discussed, and the bonding agent, described as an epoxy for the preferred embodiment, may be any adhesive which is able to bond the primary shell materials or adhere the primary shell to the comfort surround. Although, the comfort surround is described as a thermoplastic elastomer or a urethane, numerous other materials may be utilized which include but are not limited to natural and synthetic rubber materials, flexible polymers, and flexible composite materials.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 2:
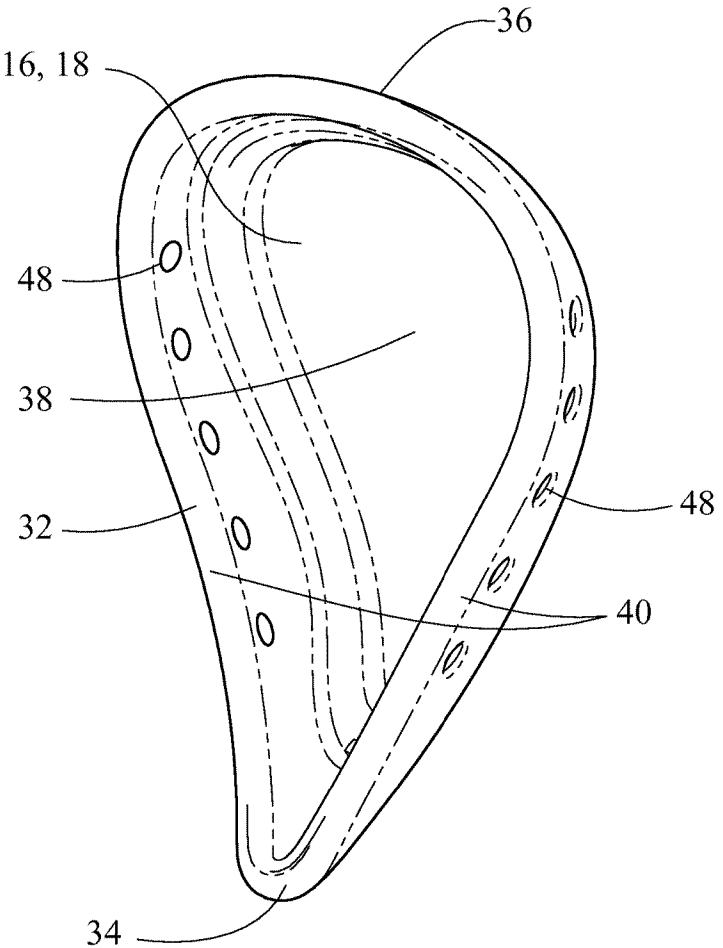
FIG. 2 is a rear perspective view of the improved composite athletic cup showing the interior cavity.
Figure 1:
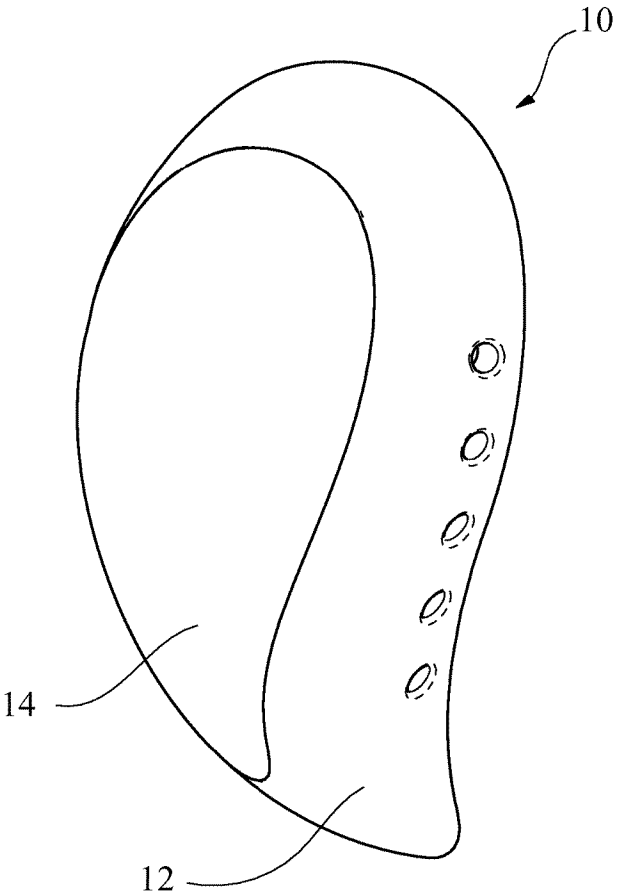
FIG. 1 is a front left perspective of a preferred embodiment of the improved composite athletic cup in assembled form.
Figure 4:
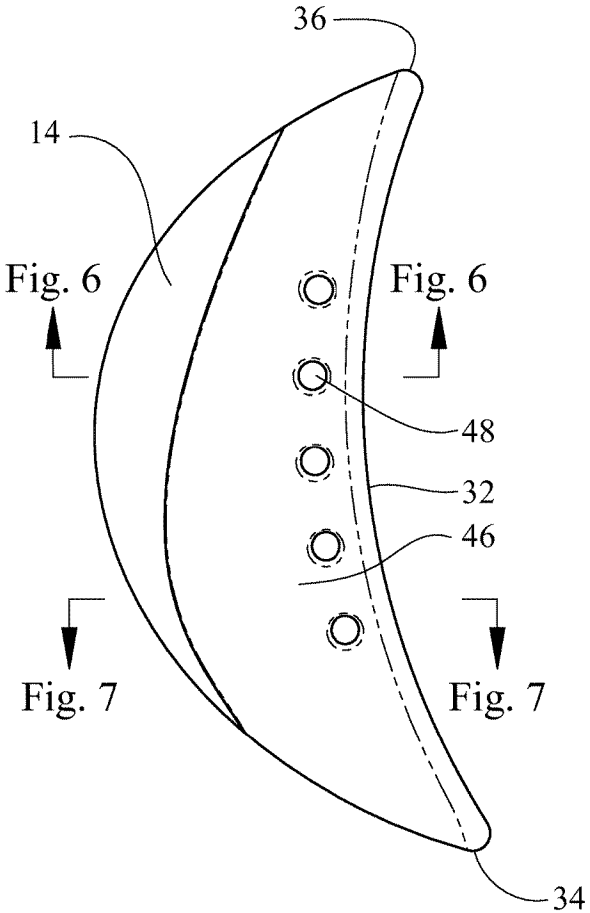
FIG. 4 is a right side plan view thereof.
Figure 3:
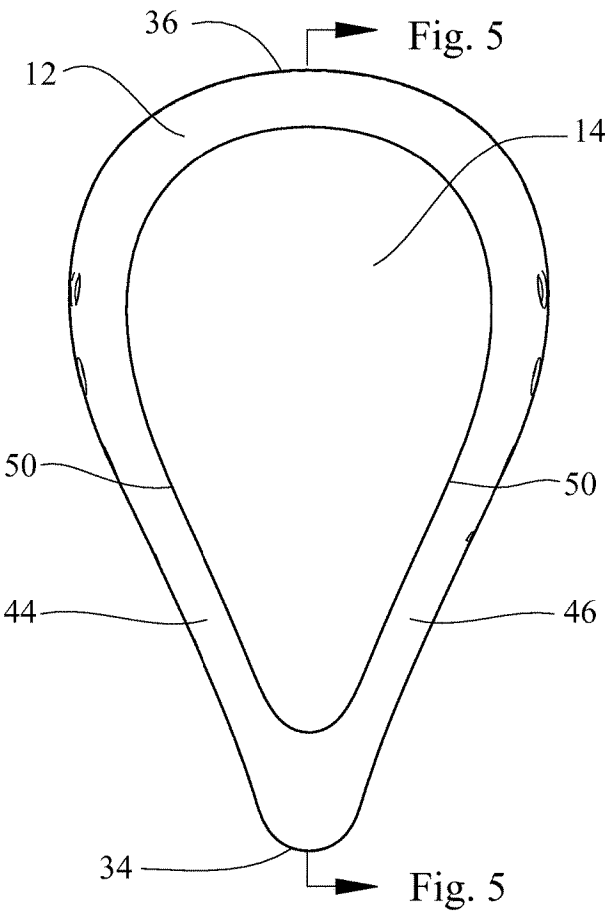
FIG. 3 is front plan view of the preferred embodiment of the improved composite athletic cup.
Figure 6:
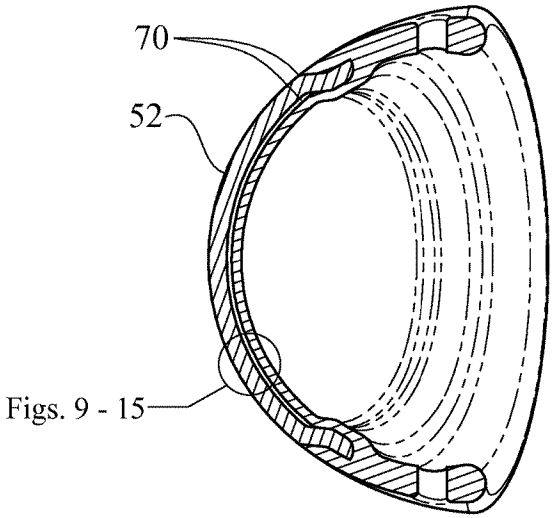
FIG. 6 is a cross sectional view taken along lines FIG. 6-FIG. 6 of FIG. 4 further showing the topmost wall diversion from center as C1.
Figure 5:
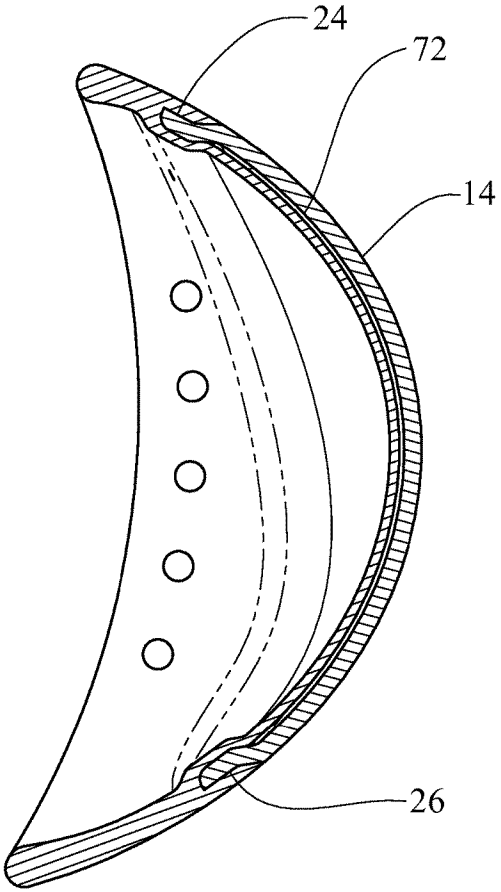
FIG. 5 is a cross sectional view taken along lines FIG. 5-FIG. 5 of FIG. 3.
Figure 8:
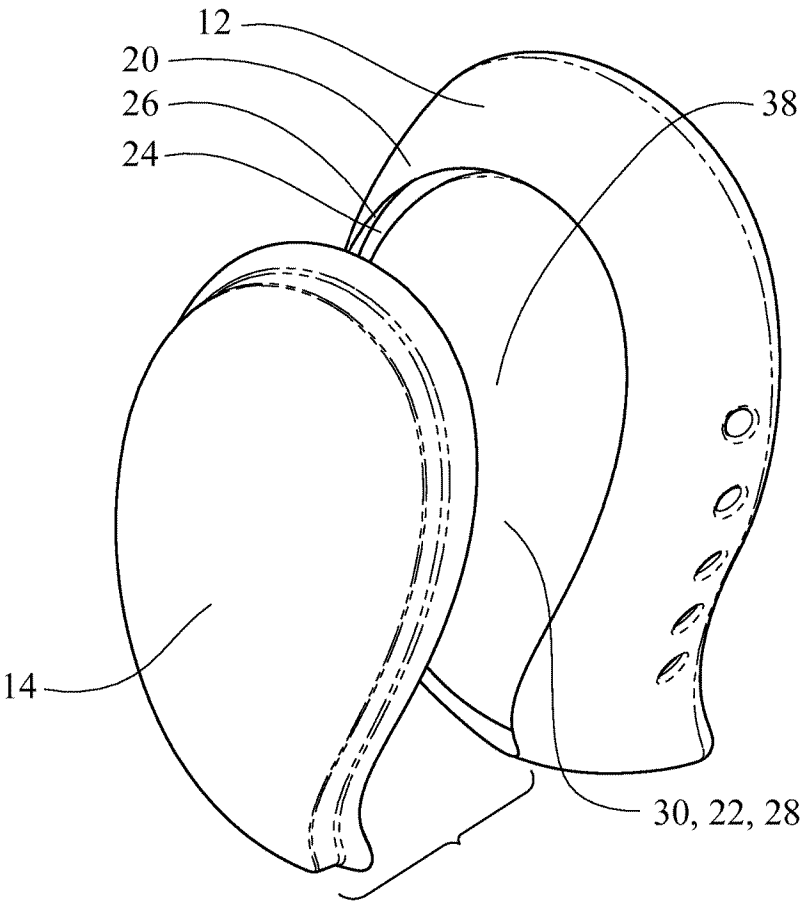
FIG. 8 is a front right perspective exploded view of a preferred embodiment of the improved composite athletic cup.
Figure 7:
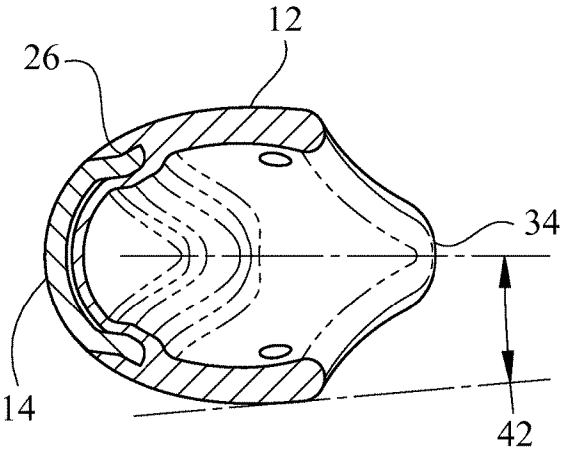
FIG. 7 is a cross sectional view taken along lines FIG. 7-FIG. 7 of FIG. 4 further showing the bottom or lower wall taper diversion toward center as C2.
Figure 10:
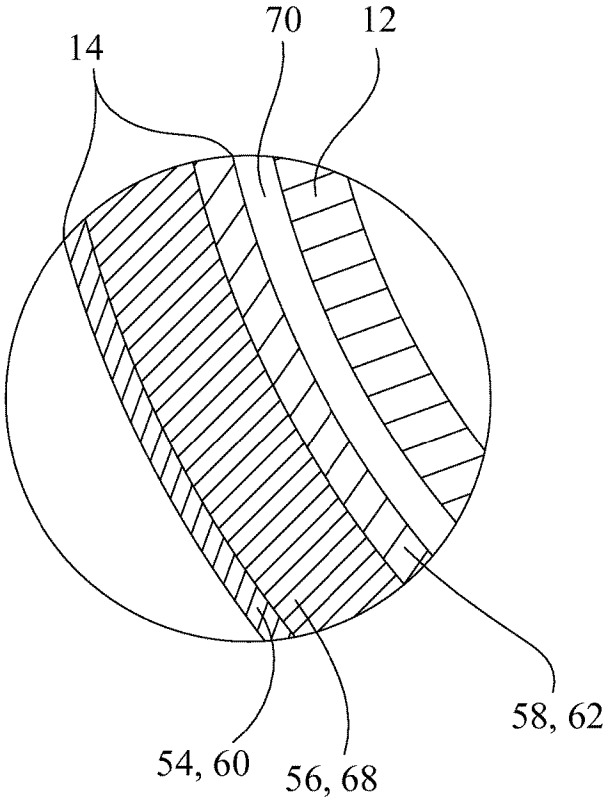
FIG. 10 is a cross sectional view of the first alternative embodiment layer structure of the front primary shell.
Figure 9:
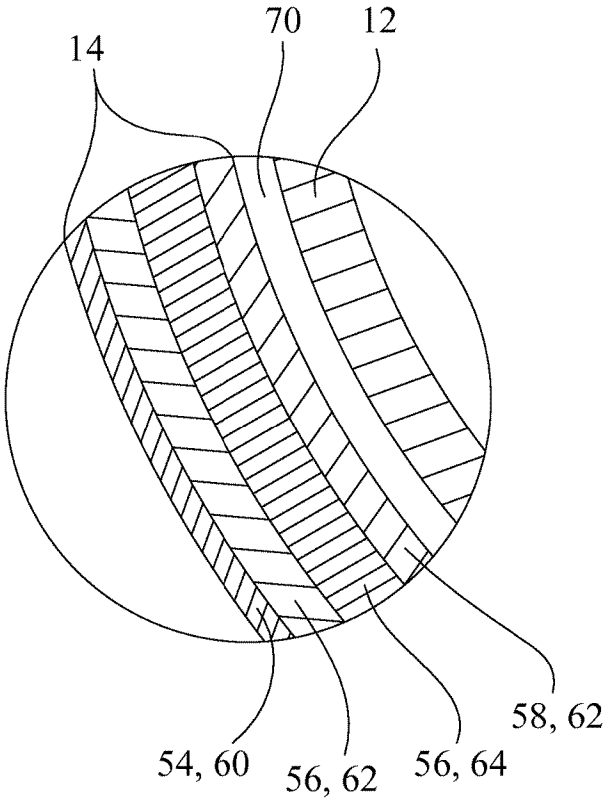
FIG. 9 is a cross sectional view of the preferred layer structure of the front primary shell.
Figure 12:
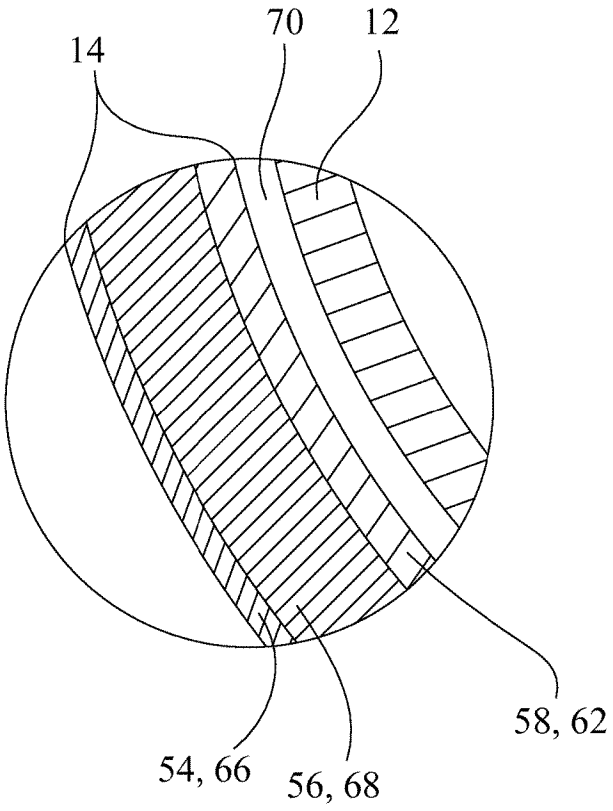
FIG. 12 is a cross sectional view of the third alternative embodiment layer structure of the front primary shell.
Figure 11:
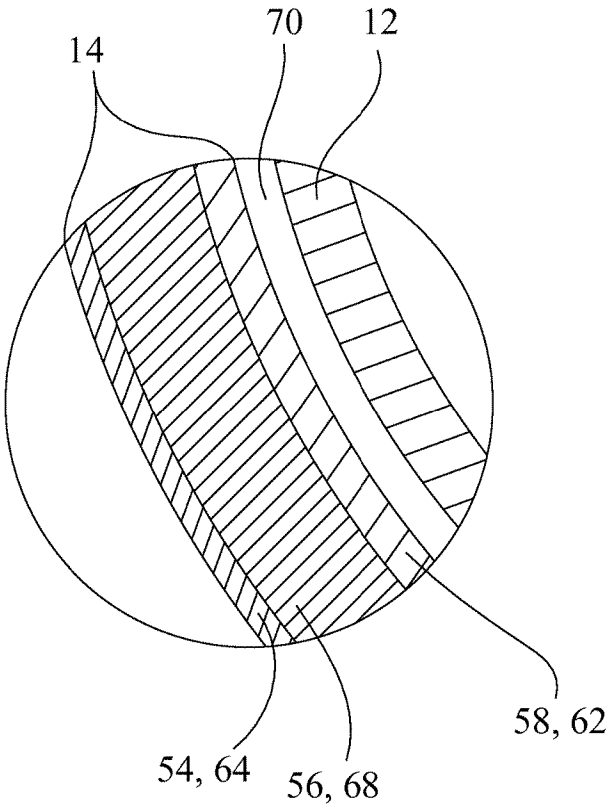
FIG. 11 is a cross sectional view of the second alternative embodiment layer structure of the front primary shell.
Figure 14:
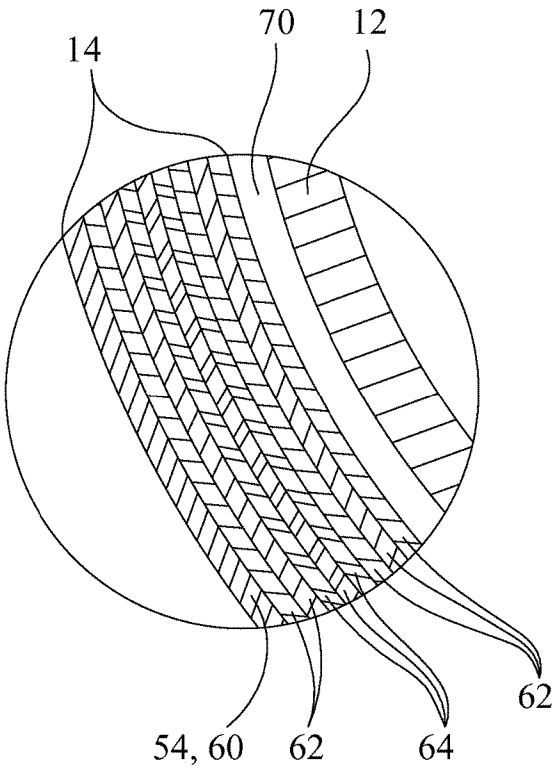
FIG. 14 is a cross sectional view of a variation on the preferred layer structure of FIG. 9.
Figure 13:
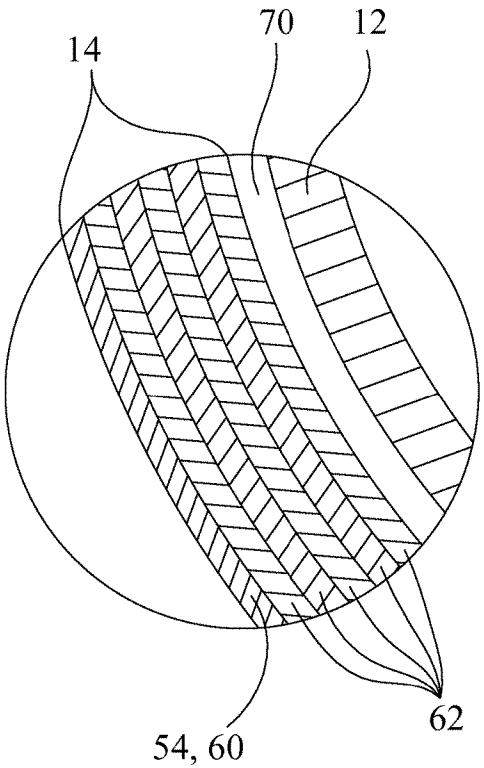
FIG. 13 is a cross sectional view of a variation on the preferred layer structure of FIG. 9.
Figure 15:
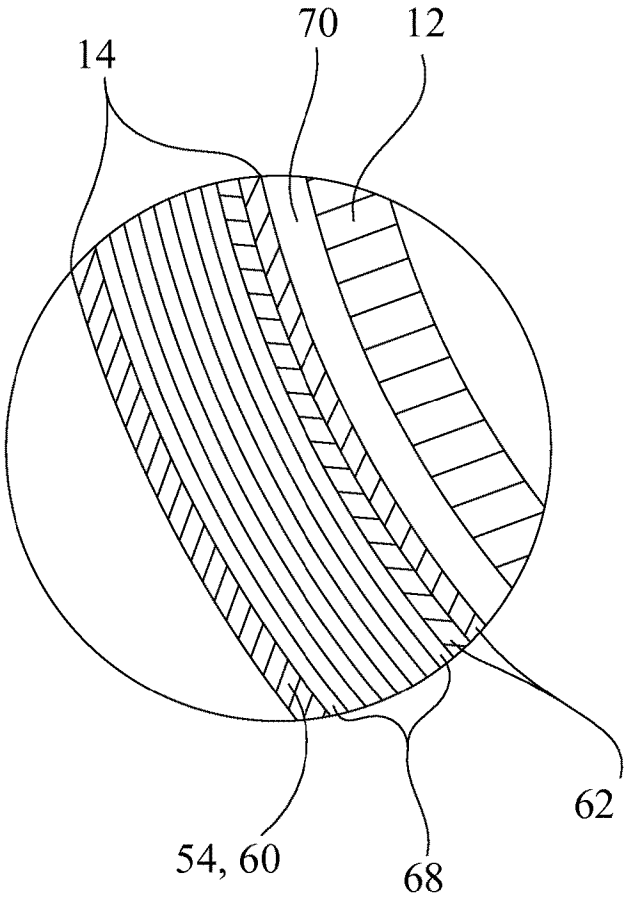
FIG. 15 is a cross sectional view of a variation on the first alternative layer structure of FIG. 10.

Referring now to the drawings, there is shown in FIGS. 1-9 a preferred embodiment of the improved composite athletic cup assembly 10 and in FIGS. 10-12 layering cross sections of the first through third alternative embodiments of the front primary shell only. FIGS. 9-12 show the layering structure forms for the front primary shell.

In accordance with the present invention, the first or preferred embodiment of an improved composite athletic cup 10 comprises a comfort surround 12 having a substantially concave form 18 interior 16 or rear 32 and a partially recessed 22 exterior 20 into which fits, mates, and is bonded a front 30 primary shell 14 of layered composites 52. The comfort surround 12 has a general form of a banana style athletic cup in a preferred embodiment yet may take a plurality of athletic cup forms in alternative embodiments including but not limited to the traditional form.

The comfort surround 12 has a generally inverted teardrop shape 28 as viewed from a front plan view and has a concave 18 interior 16 which fits over the groin area of the user. The comfort surround 12 front 30 has a slight recess 22 also having an inverted teardrop shape into which the front primary shell 14 is placed and bonded, preferably with an epoxy type material. For the preferred embodiment, the front 30 recess 22 has a surrounding channel or groove 24 into which the front primary shell 14 edges 50 fit. The preferred embodiment surrounding channel 24 has an inverted taper 26 within and into which said epoxy or bonding material 70 may form a mechanical bond with the comfort surround 12 and mechanically hold the front primary shell 14. That is, for a preferred embodiment, the surrounding channel 24 is smaller or has a narrower width nearest the front 30 and of a larger or wider width as it progresses toward the rear 32 or toward the interior 16. Alternative embodiments may forego use of the channel 24, the inverted channel or groove taper 26, without departing from the present art. Also as contemplated for the present art apparatus 10, said surrounding channel 24 may be recessed toward the outer walls 40 within said comfort surround 12 whereby the outer edges 50 of the primary shell 14 fit within the recessed channel 24 and are further held in the front 30 and rear 32 by said comfort surround 12.

Unique to the present art comfort surround is the slight taper 42 of the outer walls 40 which transition from the rear 32 toward the front 30 of the comfort surround 12. The outer walls 40 taper in nearest the rear 32, i.e. toward the interior 16 or center 38, and taper out nearest the front 30, i.e. away from the interior 16 or center 38. That is, the outer walls 40 are inset slightly nearest the rear 32 relative to the front 30. The separation between left 44 and right 46 outer walls 40 is less nearest the rear 32 and greater nearest the front 30. For the preferred embodiment the wall taper 42 extends from at or near the bottom 34 of the comfort surround 12 athletic cup approximately ¾ of the way towards the top 36 of the comfort surround 12. Alternative embodiments may utilize said taper 42 on the full length of the walls 40 or on less than ¾ of the length without departing from the scope and spirit of the present invention. Traditional banana style and other athletic cups have substantially straight walls from rear to front. When impacted, the traditional designs tend to collapse on one or both wall sides and allow for injury to the person. The present art tapered 42 walls 40 force the comfort surround 12 athletic cup 10 to elongate from top 36 to bottom 34, thereby spreading the impact energy onto a greater area and maintaining protection for the user. That is, when impacted, the walls 40 are held by the exterior 20 portion of the front 30 and prevented from spreading. Without the taper, the walls 40 would tend to flex outward near the rear 32 of the comfort surround 12 and allow the concave 18 interior 16 to collapse. The walls of the aforesaid comfort surround 12 also have one or more holes 48 there through which allow ventilation into and/or through the interior 16 concave portion 18.

For the preferred embodiment, the comfort surround 12 is manufactured from a lightweight thermoplastic elastomer which preferably has an added foaming agent for reduced weight. Alternative embodiments may utilize a urethane material or other rubber like materials. The preferred method of manufacturing with the aforesaid materials is via molding with alternative methods utilizing a plurality of manufacturing techniques including but not limited to computer numerical control (CNC) milling and rapid prototyping techniques.

The front 30 primary shell 14 of layered composites 52 also has an inverted teardrop shape 28 which closely matches, mates with, and fits into the front 30 recess 22 with the outer edges 50 of the front 30 primary shell 14 fitting within the surrounding channel or groove 24. The front 30 primary shell 14 is preferably compression formed, trimmed, and inserted with an adhesive or bonding agent 70, preferably an epoxy, into the front 30 recess and channel or groove 24.

Unique to a preferred embodiment of the present art, the front 30 primary shell 14 has the layer structure of an outer layer 54 or frontmost carbon fiber 60 layer, a middle layer 56 of two layers of KEVLAR® 29 62, followed by three layers of E-glass fiberglass 64 (alumino-borosilicate glass), and an innermost or inner layer 58 of three layers of KEVLAR® 29 62 which forms the inner or rearmost layer 58. A first alternative embodiment utilizes a front 30 primary shell 14 with a layer structure of an outer layer 54 or frontmost carbon fiber 60, a middle layer 56 of ultra high molecular weight polyethylene fiber 68 often described with the trade name DYNEEMA® 68 and manufactured by DSM Dyneema of Evansville, Ind., USA, and a inner 58 or rearmost layer of KEVLAR® 62 (poly-paraphenylene terephthalamide). The aforesaid layering structure provides the stiffness due to the outer carbon fiber 60 and inner KEVLAR® 62 layers, the outer hardness for impact blows due to the outer carbon fiber layer 60, and superior projectile protection due to the sandwiched DYNEEMA® 68 or E-glass layer 64. Since DYNEEMA® 68 is generally a more pliable material, stiffness is assured with the surrounding carbon fiber 60 and KEVLAR® 62 layers. The aforesaid combination which has the notable ability to stop small arms projectiles, is the result of substantial engineering, testing, prototyping, and continual and repeated efforts of the Applicant in order to achieve the desired ballistic hardening. As Applicant has found, there is no handbook, textbook, or course on how to optimally formulate a layered composite structure for athletic cups which protects against small arms projectiles. The KEVLAR® 62 material is preferably of the KEVLAR® 29 variety although alternative embodiments may utilize the KEVLAR® 49 variety.

For the preferred and alternative embodiments, each of the aforesaid layers are utilized in a preferably woven cloth configuration of the constituent fibers. The outer carbon fiber layer 60 is placed within a mold and substantially covered on a backside with an epoxy resin, the DYNEEMA® 68, E-glass 64, or KEVLAR® 62 layer(s) is laid upon this carbon fiber 60/epoxy combination, and another layer of epoxy resin is laid upon the DYNEEMA® 68, E-glass 64, or KEVLAR® 62 prior to placing or laying the back, rear, or inner layer(s) 58 of KEVLAR® 62 thereupon in order to form the front 30 primary shell 14. The mating portion of said mold is then placed upon the aforesaid sandwich, i.e. forming a compression die, compressed with a force of approximately 3000 pounds per square inch (≈21 Mega Pascals) and heated for approximately fifteen minutes at 250-300 degrees Fahrenheit (107-135 degrees Celsius). The temperature and pressure over the aforesaid time period bond the aforesaid layers together and form the front 30 primary shell 14 which is capable of withstanding blunt as well as small arms projectile impacts. Upon release from the mold or die, the front 30 primary shell 14 is trimmed around the edges in order to fit the front 30 recess 22 and surrounding channel or groove 24. Also, the interior surface 72 of the primary shell 14 is roughened in order to create a mechanical as well as a chemical bond with the bonding material 70 or epoxy utilized to attach the front 30 primary shell 14 with the comfort surround 12.

Also for the preferred embodiment, the KEVLAR® 62 layer immediately behind the frontmost or outer 54 carbon fiber layer 60 comprises two layers of KEVLAR® 29 62 followed by three layers of E-glass 64 which is then followed by three layers of KEVLAR® 29 62. For the first alternative embodiment, the DYNEEMA® 68 layer comprises eight layers of HB26 fabric (a unidirectional composite of DYNEEMA® manufactured by DSM Dyneema of Evansville, Ind., USA) which has a self impregnated or embedded resin matrix and the KEVLAR® 62 layer comprises two layers of KEVLAR® 29 62. The bonding material 70 or epoxy material is preferably a toughened epoxy having good adhesion properties with each of the layers. Further alternative embodiments of the present art substitute a fiberglass 64 or KEVLAR® 62 layer for the outer layer 54 carbon fiber 60 layer.

As discussed, the comfort surround 12 has a much lower durometer rating than the primary shell 14 which is substantially rigid prior to impact. That is, the comfort surround 12 Shore A durometer rating is preferably between 30 and 70 whereas the primary shell 14 preferably has a Shore D durometer rating greater than 50. Upon impact, the comfort surround 12 deforms lengthwise, i.e. from top 36 to bottom 34, and absorbs the energy transferred from the primary shell 14. The elongation serves as an energy absorption mechanism and the lower durometer rating of the comfort surround 12 presents a soft interface with the user's body. The hard carbon fiber 60 (alternatively fiberglass 64 or KEVLAR® 62) exterior 54 protects against blunt impacts and transfers energy to the comfort surround 12 while the DYNEEMA® 68 or E-glass 64 further serves to protect against small arms projectile impacts. In combination, the present art athletic cup 10 provides protection for traditional sporting applications as well as anticipated threats which are encountered by law enforcement and military personnel.

Although described for enablement purposes, the lengths, widths, durometer ratings, and other dimensional attributes may depart significantly from those specified. The shape, size, location, component numbers and mounting methods utilized for each of the components or constituent elements may take a plurality of forms as recognized within the pertinent arts without departing from the scope and spirit of the present invention. The actual number of layers for each outer 54, middle 56, and inner 58 layer material(s) may depart from those specified without departing from the scope and spirit of the present invention.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and their equivalents.

What is claimed is:

1. An improved composite athletic cup comprising:

a comfort surround of a flexible material having an interior of a substantially concave form configured to substantially cover a groin area, an exterior, a front, a rear, a bottom, a top, a center, and two outer walls; and at least a portion of said two outer walls having a transition taper from the front toward the rear and toward said interior or said center nearest the rear whereby said outer shell elongates from the top to the bottom during an impact rather than collapsing and said outer walls taper out nearest the front and are inset slightly nearest the rear and have a separation between a left outer wall and a right outer wall which is less nearest the rear and greater nearest the front; and a primary shell comprising one or more outer edges, an interior surface, and one or more layered composites; and said exterior of said comfort surround at said front having a slight recess of a size and a shape capable of accepting said primary shell; and said one or more layered composites comprising one or more outer layers, one or more middle layers, and one or more inner layers; and a bonding material between at least a portion of said interior surface or said outer edges of said primary shell and said comfort surround; and said comfort surround having a durometer rating which is more flexible than said primary shell.

2. The improved composite athletic cup as set forth in claim 1, whereby:

said comfort surround is manufactured from a thermoplastic elastomer having a foaming agent whereby weight is reduced.

3. The improved composite athletic cup as set forth in claim 2, further comprising:

one or more holes within said outer walls of said comfort surround whereby a ventilation is allowed into or through said interior substantially concave portion.

4. The improved composite athletic cup as set forth in claim 1, whereby:

said transition taper from the front toward the rear and toward said interior or said center of said comfort surround is located from at or near the bottom of the comfort surround approximately ¾ of the way towards the top of said comfort surround.

5. The improved composite athletic cup as set forth in claim 1, whereby:

said slight recess of said comfort surround having a surrounding channel or groove into which said outer edges of said primary shell fit.

6. The improved composite athletic cup as set forth in claim 5, further comprising:

an inverted taper within said surrounding channel or groove which is smaller or has a narrower width nearest said front and of a larger or wider width as said inverted taper progresses toward said rear and into which said bonding material forms a mechanical bond with said comfort surround.

7. The improved composite athletic cup as set forth in claim 1, whereby said one or more layered composites of said primary shell comprise:

one or more outer layers of carbon fibers; and one or more middle layers of KEVLAR® or E-glass fibers; and one or more inner layers of KEVLAR®.

8. The improved composite athletic cup as set forth in claim 1, whereby said one or more layered composites of said primary shell comprise:

one or more outer layers of carbon fibers; and one or more middle layers of DYNEEMA® or ultra high molecular weight polyethylene fibers; and one or more inner layers of KEVLAR®.

9. The improved composite athletic cup as set forth in claim 1, whereby said one or more layered composites of said primary shell comprise:

one or more outer layers of carbon fibers; and one or more inner layers of KEVLAR®.

10. The improved composite athletic cup as set forth in claim 1, whereby said one or more layered composites of said primary shell comprise:

one or more outer layers of fiberglass fibers or KEVLAR®; and one or more middle layers of DYNEEMA® or ultra high molecular weight polyethylene fibers; and one or more inner layers of KEVLAR®.

11. The improved composite athletic cup as set forth in claim 1, whereby said one or more layered composites of said primary shell comprise:

a single outer layer of carbon fibers; and five to seven inner layers of KEVLAR®.

12. The improved composite athletic cup as set forth in claim 1, whereby said one or more layered composites of said primary shell comprise:

a single outer layer of carbon fibers; and a middle layer of two layers of KEVLAR® and three layers of E-glass; and three inner layers of KEVLAR®.

13. The improved composite athletic cup as set forth in claim 1, whereby said one or more layered composites of said primary shell comprise:

a single outer layer of carbon fibers; and a middle layer of one layer of KEVLAR® and eight layers of DYNEEMA® or ultra high molecular weight polyethylene fibers; and one inner layer of KEVLAR®.

14. The improved composite athletic cup as set forth in claim 4, whereby said one or more layered composites of said primary shell comprise:

one or more outer layers of carbon fibers; and one or more middle layers of KEVLAR® or E-glass fibers; and one or more inner layers of KEVLAR®.

15. The improved composite athletic cup as set forth in claim 4, whereby said one or more layered composites of said primary shell comprise:

one or more outer layers of carbon fibers; and one or more middle layers of DYNEEMA® or ultra high molecular weight polyethylene fibers; and one or more inner layers of KEVLAR®.

16. The improved composite athletic cup as set forth in claim 4, whereby said one or more layered composites of said primary shell comprise:

one or more outer layers of carbon fibers; and one or more inner layers of KEVLAR®.

17. The improved composite athletic cup as set forth in claim 4, whereby said one or more layered composites of said primary shell comprise:

one or more outer layers of fiberglass fibers or KEVLAR®; and one or more middle layers of DYNEEMA® or ultra high molecular weight polyethylene fibers; and one or more inner layers of KEVLAR®.

18. The improved composite athletic cup as set forth in claim 4, whereby said one or more layered composites of said primary shell comprise:

a single outer layer of carbon fibers; and five to seven inner layers of KEVLAR®.

19. The improved composite athletic cup as set forth in claim 4, whereby said one or more layered composites of said primary shell comprise:

a single outer layer of carbon fibers; and a middle layer of two layers of KEVLAR® and three layers of E-glass; and three inner layers of KEVLAR®.

20. The improved composite athletic cup as set forth in claim 4, whereby said one or more layered composites of said primary shell comprise:

a single outer layer of carbon fibers; and a single layer of KEVLAR® behind said outer layer of carbon fibers; and a middle layer of eight layers of DYNEEMA®; and a single inner layer of KEVLAR®.

* * * * *